US005246820A

United States Patent [19]

Mooberry et al.

[11] Patent Number: 5,246,820

[45] Date of Patent: Sep. 21, 1993

[54] CARBAMIC ACID SOLUBILIZED SMEARING COUPLERS

[75] Inventors: Jared B. Mooberry; James J. Seifert, both of Rochester; Stephen P. Singer, Spencerport, all of N.Y.

[73] Assignee: Eastman Kodak Company

[21] Appl. No.: 845,290

[22] Filed: Mar. 3, 1992

[51] Int. Cl.[5] ..... G03C 7/32; G03C 7/38

[52] U.S. Cl. ..... 430/387; 430/226; 430/372; 430/376; 430/386; 430/543; 430/548; 430/554; 430/555; 430/958

[58] Field of Search ..... 430/226, 543, 548, 958, 430/555, 554, 372, 376, 386, 387, 552, 553, 556, 557, 558 R, 558 A

[56] References Cited

U.S. PATENT DOCUMENTS

| | | | |
|---|---|---|---|
| 4,420,556 | 12/1983 | Booms et al. | 430/549 |
| 4,489,155 | 12/1984 | Sakanoue et al. | 430/505 |
| 4,536,472 | 8/1985 | Kato et al. | 430/505 |
| 4,567,135 | 1/1986 | Arakawa et al. | 430/505 |
| 4,668,610 | 5/1987 | Delprato et al. | 430/558 A |
| 4,684,604 | 8/1987 | Harder | 430/375 |
| 4,705,743 | 11/1987 | Mihayashi et al. | 430/385 |
| 4,729,944 | 3/1988 | Mihayashi et al. | 430/376 |
| 4,840,884 | 6/1989 | Mooberry et al. | 430/557 |
| 5,019,492 | 5/1991 | Buchanan et al. | 430/543 |
| 5,051,343 | 9/1991 | Lestina et al. | 430/393 |

FOREIGN PATENT DOCUMENTS

| | | |
|---|---|---|
| 0096873A2 | 12/1983 | European Pat. Off. . |
| 0135883A2 | 4/1985 | European Pat. Off. . |
| 0230975A2 | 8/1987 | European Pat. Off. . |
| 2141250A | 12/1984 | United Kingdom . |

*Primary Examiner*—Richard L. Schilling
*Attorney, Agent, or Firm*—Foley & Lardner

[57] ABSTRACT

A photographic element having improved granularity contains a dye-forming coupler containing a carbamic acid precursor capable of being converted into a carbamic acid group during processing, and wherein after processing the carbamic acid group decomposes, leaving the dye substantially non-diffusable.

31 Claims, No Drawings

CARBAMIC ACID SOLUBILIZED SMEARING COUPLERS

BACKGROUND OF THE INVENTION

This invention pertains to silver halide photographic materials, in particular to color photographic materials having reduced granularity achieved by incorporating a novel carbamic acid solubilized smearing coupler into the material.

Photographic coatings incorporating color couplers and light-sensitive silver halide emulsions have been known for many years. Generally, such couplers include ballast groups of sufficient size to immobilize both the coupler and a dye formed from the coupler on reaction with oxidized color developing agent during development. The corresponding silver image formed is then bleached and removed by a fixing bath to leave a colored image composed only of dye. Materials of higher photographic speed have required the use of larger silver halide grains which results in a color image formed from larger dye clouds. This has led in many cases to an undesirable grainy appearance. A physical measurement of such graininess is termed granularity. Granularity is due to the formation of dye deposits only in the immediate area of the silver grain where oxidized developer is formed, thus creating micro regions of high and low density.

U.S. Pat. No. 4,420,556 to Booms et al. describes the usefulness of photographic dyes which have the ability to diffuse a small distance from their generation site, that is, smear, and thus increase covering power and reduce granularity. Covering power is the density produced by a fixed amount of dye per unit area. The couplers described are two-equivalent couplers in which the primary ballast is attached to a part of the coupler moiety that does not form a dye upon reaction with oxidized developer. The ballast hinders or prevents diffusion before development, but upon development the ballast groups are detached and the resulting dye is free to diffuse through the film. This results in good granularity because the diffusion will tend to smooth out micro density variations. However, once the ballast is lost, diffusion is only controlled by the nature of the substituents left on the dye itself. Booms et al. attach a secondary ballast to the coupler to render the dye slightly mobile during development. However, if the diffusion, or smearing, continues even after development because the dye remains mobile, there will be an undesirable loss in image sharpness with time. This is because sharpness is a function of the gradient between two closely spaced regions of high and low density, that is, an edge. Post-process dye diffusion will allow dye to move from high to low density regions, reducing the gradient and will lead to total loss of image structure with time.

A second embodiment of the Booms et al. patent involves incorporating a coupler yielding a diffusible dye, and controlling smearing by immobilizing this dye on a nearby mordant before it diffuses too great a distance. The degree of smearing is controlled by positioning of the mordant a certain distance from the color coupler. The greater the distance, the greater will be the degree of image smearing.

Additional documents relating to reducing graininess through the use of dye smearing include U.K. Patent Application 2,141,250 which achieves increased sensitivity and improvements in granularity with the use of smearing couplers with silver halide emulsions that have an average size above 1.5 micrometers. U.S. Pat. No. 4,840,884 discloses couplers that release a shifted azoaniline dye as a carbamic acid derivative upon reaction with oxidized developer. The carbamic acid group is not stable and decomposes later in the process to give carbon dioxide and unshifted azoaniline dye. U.S. Pat. No. 4,489,155 describes the use of couplers which yield somewhat diffusible dyes where the size of the dye cloud is limited by including competitors which scavenge oxidized developer. A similar result is obtained using combinations of immobile dye-producing high activity couplers with couplers which yield diffusible dyes, as disclosed in U.S. Pat. No. 4,567,135. European Patent 96,873 seeks improved granularity and sharpness by employing matched activity combinations of DIR couplers with couplers producing controlled smearing dyes. U.S. Pat. Nos. 4,536,472; 4,705,743; and 4,729,944, and European Patent Applications 135,883 and 230,975 examine combinations of controlled smearing dye couplers with silver halide emulsions of various descriptions. U.S. Pat. No. 5,051,343 relates to couplers that are removed from a film element if they do not undergo reaction with oxidized developer.

Solubilizing substituents that are at least partly ionizable in the developer such as carboxylic acids or sulfonamides allow for good diffusion during development, but do not prevent continued smearing after processing is completed. Alternatively, if the dye has no ionizable groups, then the rate of post-processing smearing can be acceptable, but the amount of smearing during development is also low. This limits the amount of the granularity improvement available from the use of this type of coupler. Accordingly, a material that contains a good solubilizing group in the developer to give good diffusion, but has no solubilization after the process is complete to prevent post-process diffusion, would be highly desirable.

Thus, there has been a need to obtain diffusion of the dye during development, but to prevent dye diffusion after processing is complete, in order to avoid loss of image structure over time. It would therefore be highly desirable to provide couplers, and photographic elements containing them, wherein diffusion of the coupler is prevented or limited before development, wherein during development the resulting dye is free to diffuse, that is, smears to reduce granularity, but wherein after processing is complete, further smearing of the image is greatly reduced so as not to undesirably reduce image sharpness.

SUMMARY OF THE INVENTION

These needs have been satisfied by providing novel photographic couplers, and photographic elements comprising the couplers.

In accordance with the invention, there is provided a photographic element comprising a support, a silver halide emulsion, and a coupler containing a carbamic acid precursor capable of being converted into a carbamic acid group, wherein during development said precursor is converted into a carbamic acid group thus allowing diffusion of the coupler or the dye derived from the coupler and whereafter the carbamic acid group decomposes into an amine and carbon dioxide resulting in a substantially non-diffusible dye.

It is further an object of the invention to provide a carbamic acid solubilized smearing coupler of the formula $$\text{COUP-L-N(R)COO-}\underset{\underset{(\text{BALLAST})_p}{|}}{(\text{T}_1)_m}\text{-}\overset{\overset{(\text{BALLAST})_q}{|}}{\text{SL}}\text{-}(\text{T}_2)_n\text{-(BALLAST)}_r$$

wherein:

COUP represents a coupler moiety,

L represents a bond or a spacing group,

R is selected from hydrogen, substituted or unsubstituted alkyl, substituted or unsubstituted aryl, or the atoms necessary to form a ring system, preferably of 5 to 7 members, which joins the nitrogen to the coupler, $T_1$ and $T_2$ are timing groups, m and n are integers from 0 to 2, SL is a splittable linking group, which is cleaved during development, BALLAST is at least one ballast group, and p, q, and r are independently 0 or 1, with at least one BALLAST group present in the smearing coupler, with the proviso that neither L nor the carbamate group (N(R)COO), is attached to COUP in a coupling position nor attached to a part of the molecule that does not form a dye when reacted with oxidized developer.

It is also an object of the invention to provide a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein the multicolor element contains a smearing coupler as defined above.

It is further an object of the invention to provide a process for developing an image in a photographic element comprising a support and a silver halide emulsion containing an imagewise distribution of developable silver halide grains, said process comprising developing said element with a silver halide color developing agent in the presence of a dye-forming coupler which comprises a carbamic acid precursor capable of being converted into a carbamic acid group, and wherein during development said precursor is converted into a carbamic acid group thus allowing diffusion of the coupler, wherein after development the carbamic acid group decomposes into an amine and carbon dioxide resulting in a substantially non-diffusible coupler.

Further objects, features, and advantages of the present invention will become apparent from the detailed description of preferred embodiments that follows.

DETAILED DESCRIPTION OF THE PREFERRED EMBODIMENTS

The COUP moiety can be derived from any couplers known in the art. Preferred are cyan, magenta, and yellow dye forming coupler moieties, although other coupler moieties can be employed, such as those which yield a colorless product or black dye upon development. There follows a listing of patents and publications from which useful coupler moieties can be selected.

Couplers which form cyan dyes upon reaction with oxidized color developing agent are described in such representative patents and publications as: U.S. Pat. Nos. 2,367,531; 2,423,730; 2,474,293; 2,772,162; 2,801,171; 2,895,826; 3,002,836; 3,034,892; 3,041,236; 3,419,390; 3,476,563; 3,772,002; 3,779,763; 3,996,253; 4,124,396; 4,254,212; 4,296,200; 4,333,999; 4,443,536; 4,457,559; 4,500,635; 4,526,864; 4,690,889; 4,775,616; and "Farbkuppler-eine Literaturüber-sicht," published in Agfa Mitteilungen, Band III, pp. 156–175 (1961). Such couplers typically are phenols and naphthols.

Couplers which form magenta dyes upon reaction with oxidized color developing agent are described in such representative patents and publications as: U.S. Pat. Nos. 1,269,479; 2,311,082; 2,343,703; 2,369,489; 2,600,788; 2,908,573; 3,061,432; 3,062,653; 3,152,896; 3,519,429; 3,725,067; 3,935,015; 4,120,723; 4,443,536; 4,500,630; 4,540,654; 4,581,326; 4,774,172; European Patent Applications 170,164; 177,765; 240,852; 284,239; 284,240; and "Farbkuppler-eine Literaturüberischt," published in Agfa Mitteilungen, Band III, pp. 126–156 (1961). Typically, such couplers are pyrazolones, pyrazolotriazoles, pyrazolobenzimidazoles, or indazoles.

Couplers which form yellow dyes upon reaction with oxidized and color developing agent are described in such representative patents and publications as: U.S. Pat. Nos. 2,298,443; 2,407,210; 2,875,057; 3,048,194; 3,265,506; 3,384,657; 3,415,652; 3,447,928; 3,542,840; 3,894,875; 3,933,501; 4,022,620; 4,046,575; 4,095,983; 4,182,630; 4,203,768; 4,221,860; 4,326,024; 4,401,752; 4,443,536; 4,529,691; 4,587,205; 4,587,207; 4,617,256; European Patent Application 296,793; and "Farbkupplereine-Literaturübersicht," published in Agfa Mitteilungen, Band III, pp. 112–126 (1961). Typically, such yellow dye forming couplers are acylacetamides, such as benzoylacetanilides and pivalylacetanilides.

Couplers which form colorless products upon reaction with oxidized color developing agent are described in such representative patents as: U.K. Patent No. 861,138; U.S. Pat. Nos. 3,632,345; 3,928,041; 3,958,993; and 3,961,959.

Couplers that form black dyes upon reaction with oxidized color developing agent are described in such patents as U.S. Pat. Nos. 1,939,231; 2,181,944; 2,333,106; and 4,126,461; and German OLS Nos. 2,644,194 and 2,650,764.

It is especially preferred to use a universal or naphtholic coupler. A universal coupler is a material which can react with oxidized color developer to produce a colorless product or a material which reacts with oxidized color developer to produce a colored compound which is soluble in developer solution and which is washed out of the film during photographic processing.

Preferred universal coupler moieties have the generic structure

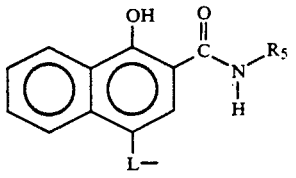

wherein $R_5$ represents a hydrogen atom, or alkyl or aryl or heterocyclic group. Preferred $R_5$ groups include H, $CH_3$, $CH_2CH_2CO_2H$, $CH_2CH_2CO_2CH_2CH_3$, $CH_2CO_2H$, $CH_2CO_2CH_2CH_3$, $CH_2CO_2CH_3$, $CH_2CH_2CO_2CH_3$, and $CH_2CH_2OCH_3$.

Examples of preferred universal coupler moieties are disclosed in U.S. Pat. No. 4,482,629.

Attached to COUP, at a noncoupling position may be one or more secondary ballasts which is of such size and configuration that the dye formed by coupling of COUP with oxidized color developing agent is of the desired mobility. The specific secondary ballast group employed will depend upon the particular coupler moiety employed, the nature of other substituents thereon, the particular color developing agent which couples with the coupler to form dye and the nature of substituents thereon. The specific secondary ballast group employed is not critical so long as it confers upon the dye the desired degree of mobility. Particularly useful secondary ballast groups include alkyl groups of 2 to 20 carbon atoms and aryl groups of 6 to 20 carbon atoms. These groups may be unsubstituted or substituted. U.S. Pat. No. 4,420,556 describes secondary ballasts useful in this invention, and is incorporated by reference.

It is also possible for a coupling off group to be attached to the COUP moiety. This group may act as a ballast prior to processing. The COUP may also have various substituents which are known in the art to control various features such as hue and activity L can be a single bond or any spacing group so long as it is not attached to COUP in a coupling position or a position that does not form a dye when reacted with oxidized developer. That is, the resultant dye contains the spacing group. Examples of useful spacing groups include the following.

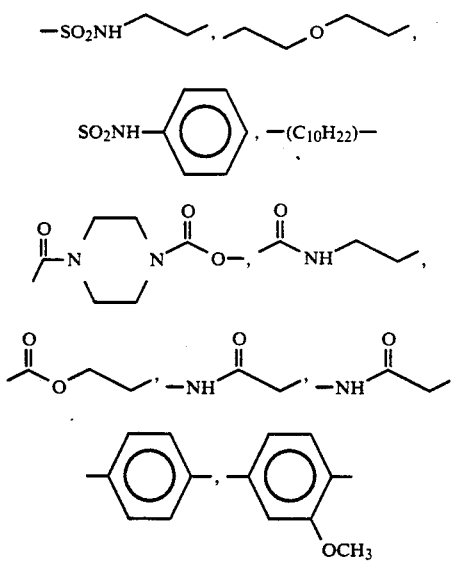

R is selected from hydrogen, substituted or unsubstituted alkyl, substituted or unsubstituted aryl, or the atoms necessary to form a ring system, preferably of 5 to 7 members, which joins the nitrogen to the COUP moiety. Since R will become part of the dye, it should not be so big as to prevent diffusion. Also the R group can be used to control diffusion by adjusting its size. Generally R may contain 1 to 20 carbons atoms, preferably 1 to 10 carbon atoms. Alkyl groups of 2 to 20 carbon atoms and aryl groups of 6 to 20 carbon atoms are useful. Suitable substituents for R include one or more of chloro, sulfonamido, carbamoyl, carboxylate, carboxy, ethers (such as methoxy and ethoxy), thioethers, and disubstituted amino.

One or more of the aforementioned secondary ballasts may also be attached to R.

Examples of useful R groups include the following.

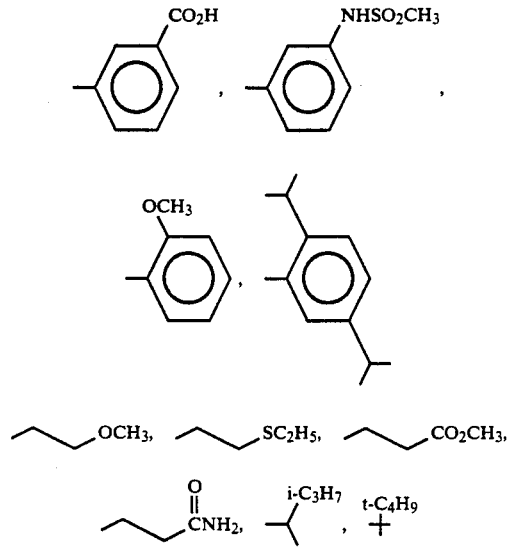

The nitrogen atom of the carbamate group is either attached directly to COUP at a non-coupling position which becomes part of the resultant dye, or to the spacing group. Specifically, the carbamate group is part of the resultant dye prior to the loss of carbon dioxide.

Any timing group which is known in the photographic art is useful as the timing groups T. Exemplary timing groups T are disclosed in U.S. Pat. Nos. 4,248,962, 4,772,537 and 5,019,492, and European Patent Application No. 255,085. Up to 2 timing groups can be joined sequentially according to the invention (that is, m and n are independently 0 to 2). Preferably, m and n are independently 0 or 1. The timing group can be unballasted or ballasted, and can contain solubilizing groups.

BALLAST can be any group of sufficient size and bulk that, with the remainder of the molecule, renders the unreacted coupler immobile, or non-diffusible in the film element prior to processing. It can be a relatively small group if the remainder of the group is relatively bulky. Preferably, the ballast is an alkyl or aryl group containing about 8 to 30 carbon atoms. These groups can be substituted or unsubstituted with groups which, for example, enhance the nondiffusibility of the coupler prior to development. The ballast can be attached in any way to the timing or SL groups. The ballast can also contain additional solubilizing groups such as carboxylic acids or sulfonamides. Suitable ballast groups are described in, for example, U.S. Pat. Nos. 4,420,556 and 4,923,789, which are incorporated by reference. The ballast group can be attached to either the timing or the SL groups, or a ballast can be attached to more than one of these. Further, the ballast group can be attached to the SL group through a timing group. The critical requirements are that the ballast render the unreacted coupler substantially immobile before processing, and that the ballast be cleaved with the SL group, and the timing group if present, during development, so that the ballast does not remain on the formed dye. Accordingly, the diffusion of the dye is determined by the substituents bonded to the COUP moiety.

The term "non-diffusible" has the meaning commonly applied to the term in photography and denotes materials that for all practical purposes do not migrate nor wander through organic colloid layers, such as gelatin, in the photographic element. The term "diffusible"0 has the converse meaning and denotes materials having the property of diffusing effectively through the colloid layer of the photographic element. The term "mobility" refers to the ability to diffuse.

SL is a splittable linking group that is cleaved during development. The cleavage can occur either in an imagewise or non-imagewise manner. Imagewise cleavage of the SL group refers to a process by which SL is removed due to reaction with Dox which is generated from the exposure of the silver halide emulsion. Non-imagewise cleavage refers to any other type of reaction that can cleave a chemical bond. The reaction with oxidized developer to form dye can occur before, concurrent with, or after the SL group is cleaved. Once the SL group (and the timing group, $T_1$, if present) is cleaved, the resulting carbamic acid- substituted dye is free to diffuse. The smearing of the dye deposit reduces granularity. After processing is completed, the carbamic acid has decomposed, thus leaving the dye without a solubilizing group. As a result, further smearing of the image is greatly reduced. Specifically, after development, the pH of the system is reduced. The carbamic acid group is unstable at low pH and decomposes to carbon dioxide and an amine group. The dye is left with only an amine group, which is not as solubilizing as a carbamic acid group. Accordingly, further post-process diffusion is minimized, as is the loss of image structure caused by post-process diffusion.

The above described pH switch is illustrated by the following equation:

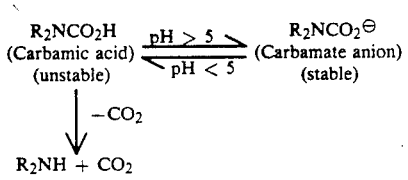

The SL group can be any group which cleaves during development so that a dye having a carbamic acid group is generated. The splittable linking group may optionally contain solubilizing groups such as carboxylic acids or sulfonamides. It may also contain a separate dye-generating coupler as described above in reference to COUP.

The cleavage between SL and the carbamate group can be accomplished by any appropriate reaction. For example, splitting of the linking group can occur by a hydrolysis reaction which is initiated by a component of one of the processing solutions, for example, an acid or base. This reaction can be assisted by a group on the coupler moiety, one or more of the ballast groups and/or the linking group, or by a group which is a separate component of one of the processing compositions, such as a nucleophile. Suitable reactions are described, for example, in U.S. Pat. No. 5,051,343 which is hereby incorporated by reference.

An exemplary reaction is the hydrolysis of an ester. For example, an imidomethyl ester or a beta- or gamma-keto ester can be hydrolyzed in the presence of base and the reaction can be accelerated by the presence of a nucleophile, such as hydroxylamine. Similarly, acetal and ketal protecting groups can be hydrolyzed in the presence of acid. In other instances hydrolysis is preceded by a separate oxidation or reduction reaction, such as the oxidation of a hydrazide group or of a sulfonamidophenol. The reactions can be anchimerically assisted.

Other appropriate cleavage reactions include elimination reactions, inter- or intramolecular nucleophilic substitution reactions or oxidation-reduction reactions, which may require further subsequent reactions for cleavage. See, for example, U.S. Pat. No. 4,684,604, which is incorporated by reference. General discussion of these types of reactions can be found in Advanced Organic Chemistry: Reactions, Mechanism and Structure by J. March, McGraw Hill Book Company, NY (1986). Preferred cleavage reactions are the hydroxylamine-based cleavage reactions. Preferred splittable linking groups which are sensitive to hydroxylamine cleavage are described in U.S. Pat. No. 5,019,492, which is hereby incorporated by reference.

Examples of useful smearing couplers of the invention include:

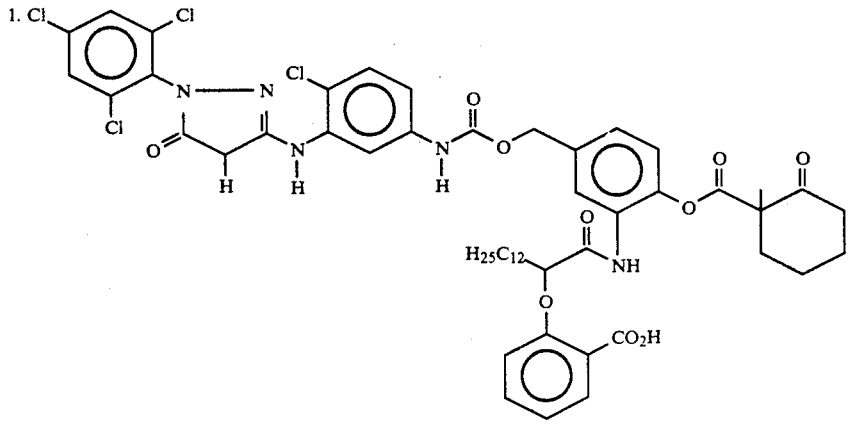

-continued
2. 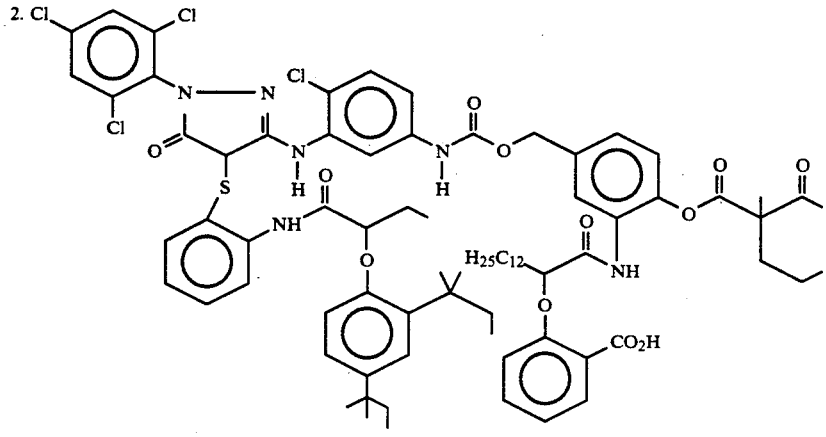
3. 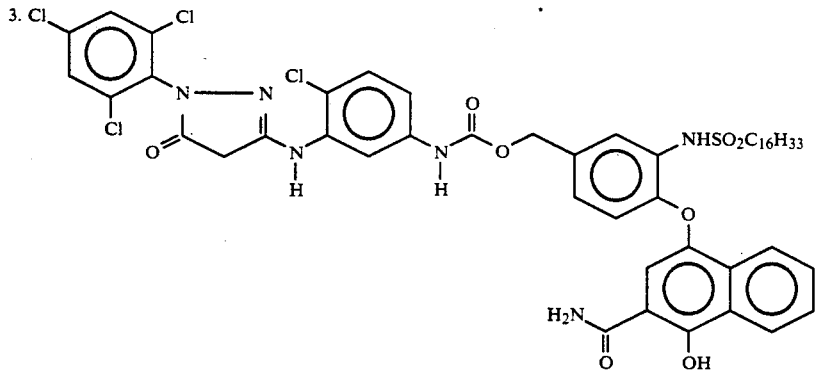
4. 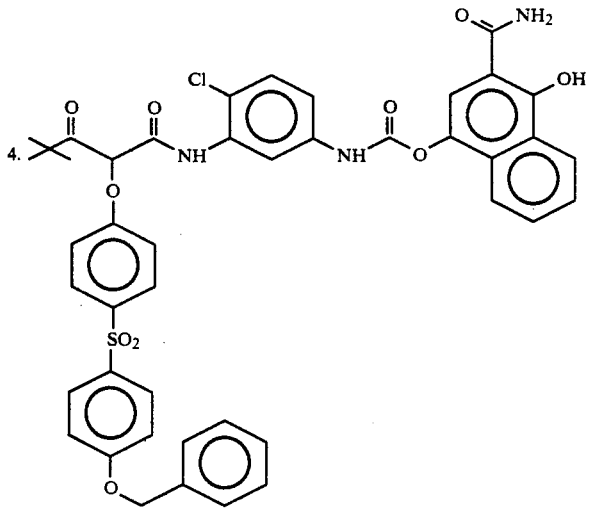

-continued
5. 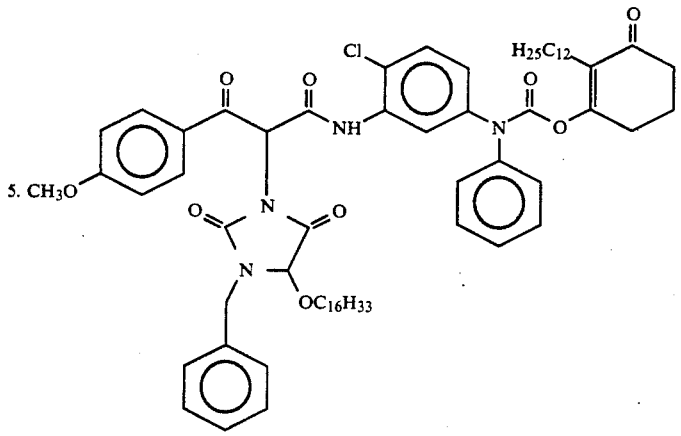
6. 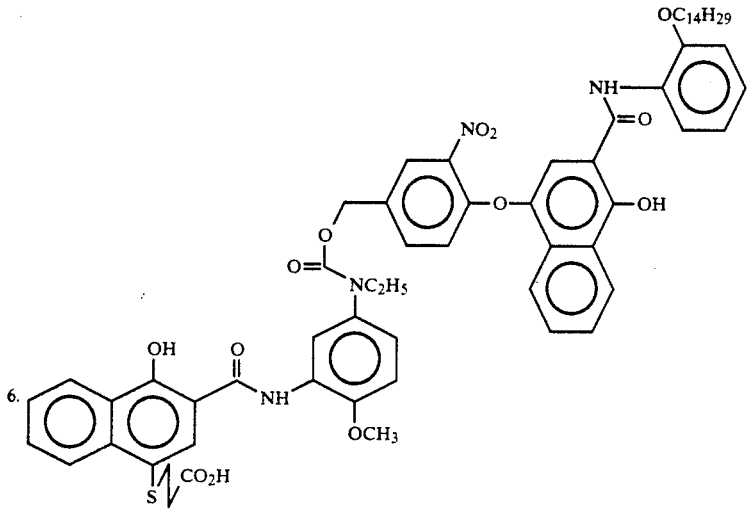
7. 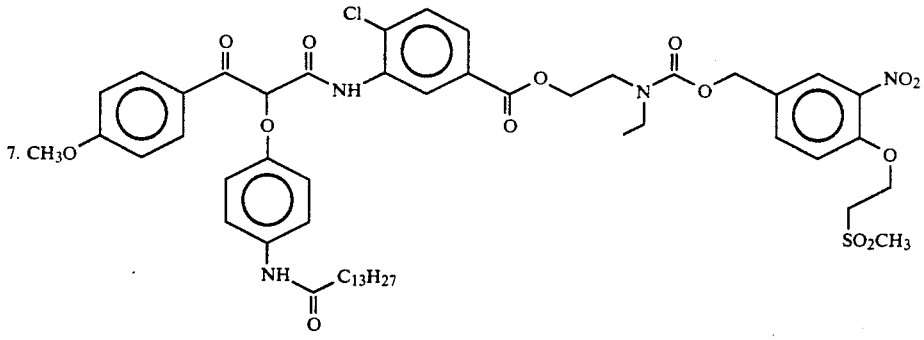
8. 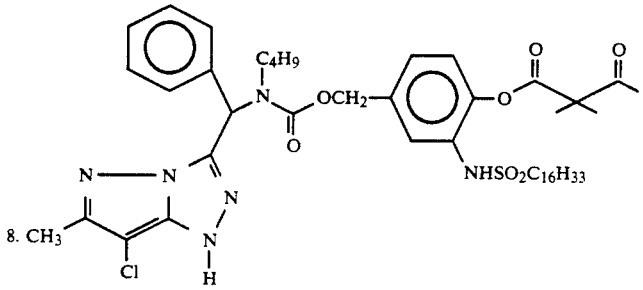

-continued
9. 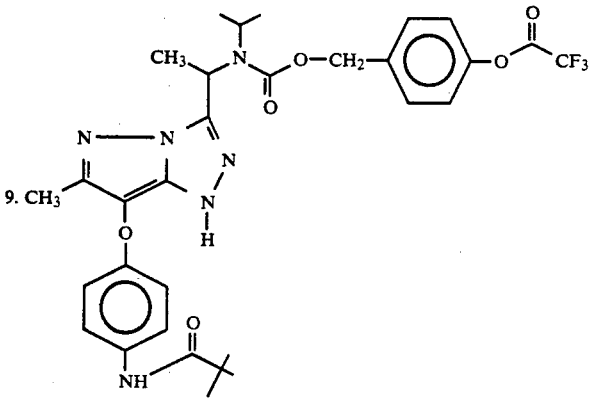
10. 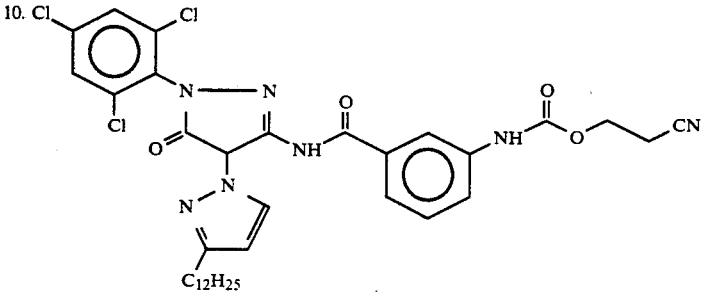
11. 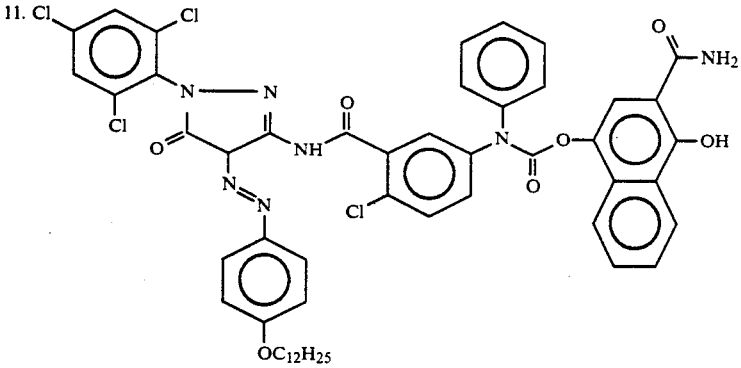
12. 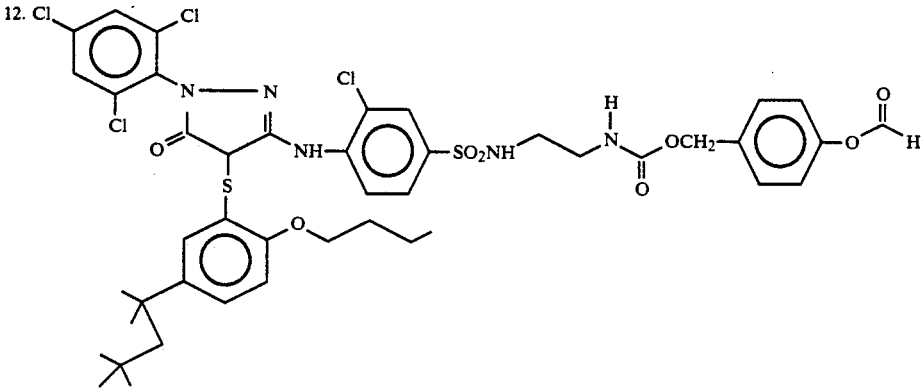

-continued
13. 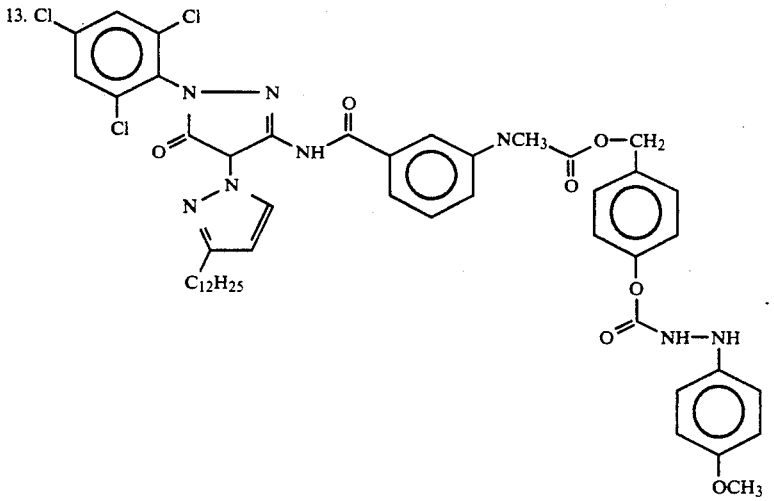
14. 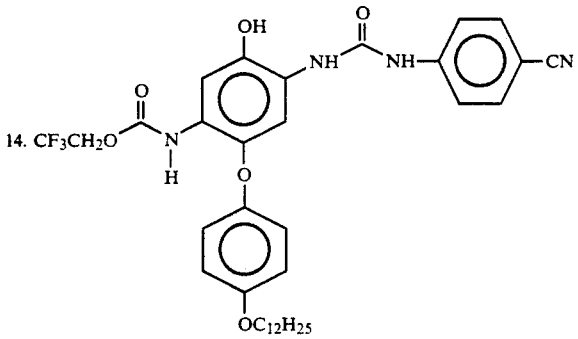
15. 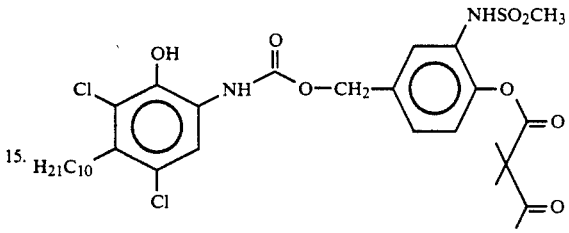
16. 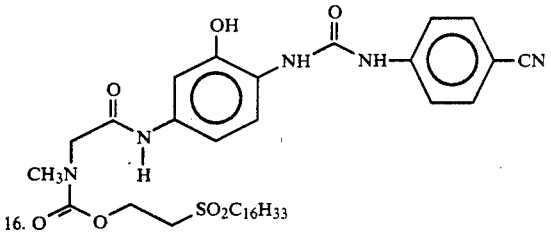
17. 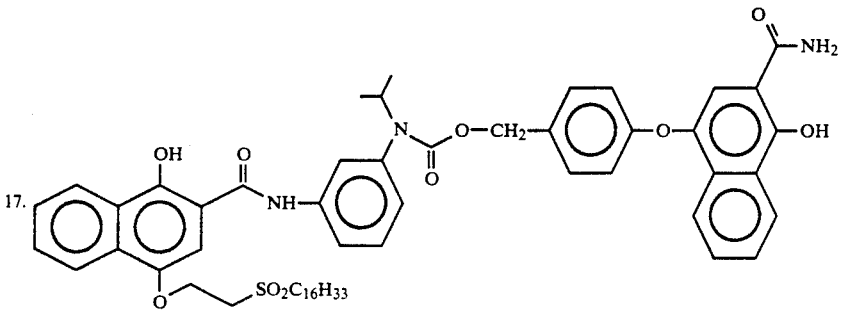

-continued

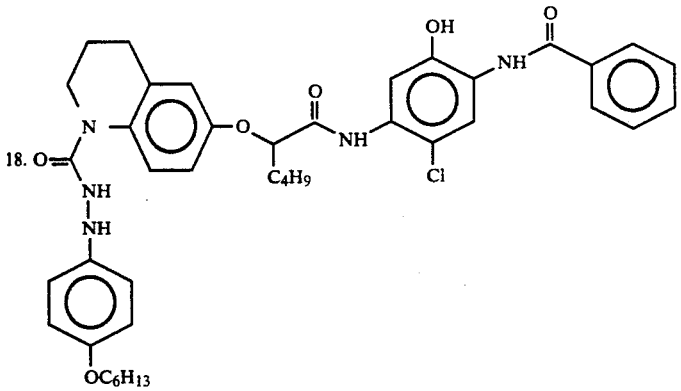

The preparation of coupler 1 will now be described. Reference is made to the preparation scheme on pages 23–25.

THF herein is tetrahydrofuran. DMF herein is n,n-dimethyl formamide, $R_3N$ is N,N-Diisopropylethylamine.

Bis ester I (50.0 g, 0.115 mole) was taken up in 200 ml THF plus 100 ml MeOH in a 500 ml 3 neck round bottom flask fitted with a mechanical stirrer. NaOH (11.5 g, 0.288 mole) was dissolved in 30 ml of $H_2O$ and added all at once to stirred solution of I. After 5 minutes the selective saponification of the methyl ester was achieved. The mixture was diluted with 250 ml ethyl acetate and washed with 150 ml of 2N HCl and then with $H_2O$. The organic layer was dried with $MgSO_4$ and concentrated to a syrupy carboxylic acid II (46.0 g, 95%).

Carboxylic acid II (100.8 g, 0.24 mole) was dissolved in a mixture of 250 mls THF in a 3 neck round bottom flask fitted with a mechanical stirrer, and an addition funnel. After cooling in an ice bath, the mixture was treated with $R_3N$ (42 ml, 0.24 mole), and a solution of isobutyl chloroformate (31.2 ml, 0.24 mole) in 50 ml THF was dripped in over 5 minutes. The reaction mixture was stirred for 30 minutes and checked by treating an aliquot with aniline to verify formation of the anhydride, compound III. Compound III was transferred to an addition funnel and dripped over 5 minutes into a vigorously stirred cold solution of dialcohol amine IV (41.6 g, 0.15 mole) in 200 ml pyridine. After 30 minutes the mixture was diluted with 300 ml ethyl acetate and washed with 240 ml of 2N HCl and then with $H_2O$. The organic layer was dried over $MgSO_4$, concentrated to 130 g crude product, and chromatographed on silica gel using dichloromethane/heptane/ethyl acetate (5/3/2) as eluent. Amide V (70.0 g) as a syrup was obtained.

Amide alcohol V (53.7 g, 0.1 mole), acid chloride VI (22.5 g, 0.1 mole) and THF (200 ml) were combined and cooled in ice. Triethylamine (28.0 ml, 0.2 mole) was added dropwise over 20 minutes with vigorous stirring. The mixture was allowed to come to room temperature and then was diluted with ethyl acetate, washed with excess IN HCl and then $H_2O$. After drying, concentrating and chromatographing using the same eluent as for V, benzylic alcohol VII (35 g) was obtained.

Phosgene (1.5 ml of 2M solution in toluene, 0.003 mole) was added to a solution of benzylic alcohol VII (2.0 g, 0.003 mole) and lutidine (0.5 g, 0.0045 mole) in 20 ml THF. The mixture was stirred at ambient temperature for fifteen minutes and then concentrated to an oil. The oil was taken up in 25 ml THF and 25 ml ligroin and concentrated to 2.2 g of chloroformate, compound VIII.

Aminopyrazolone IX (1.2 g, 0.003 mole) was dissolved in 15 ml THF and 10 ml DMF in a 3 neck round bottom flask fitted with mechanical stirrer and addition funnel, and cooled in an ice/dry ice bath. Lutidine (0.5 g, 0.0045 mole) was added, and then chloroformate compound VIII (2.2 g, 0.003 mole) in 10 ml THF was dripped in over 3 minutes with vigorous stirring. The reaction mixture was stirred for 30 minutes, diluted with ethyl acetate, washed with excess 1N HCl, and then with $H_2O$. The organic layer was dried over $MgSO_4$, concentrated to 3.0 g crude product, and chromatographed on silica gel using dichloromethane heptane/ethyl acetate (5/3/2) as eluent. Compound X (1.3 g) as a foam was obtained.

Coupler X (1.3 g 0.0012 mole) was dissolved in 10 ml dichloromethane. Trifluroracetic acid (7.7 g, 5 ml, 0.067 mole) was added and the reaction mixture was stirred for fifteen minutes. The reaction was then diluted with 50 ml of ethyl acetate and washed with excess 1N $NaHCO_3$, then $H_2O$, then 1N HCl, and lastly $H_2O$. The organic phase was dried over $MgSO_4$ and concentrated to a foam (1.2 g), coupler 1.

Preparation Scheme For Coupler 1

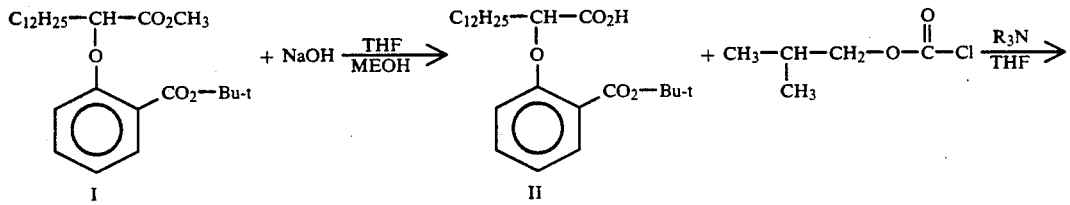

-continued
Preparation Scheme For Coupler 1
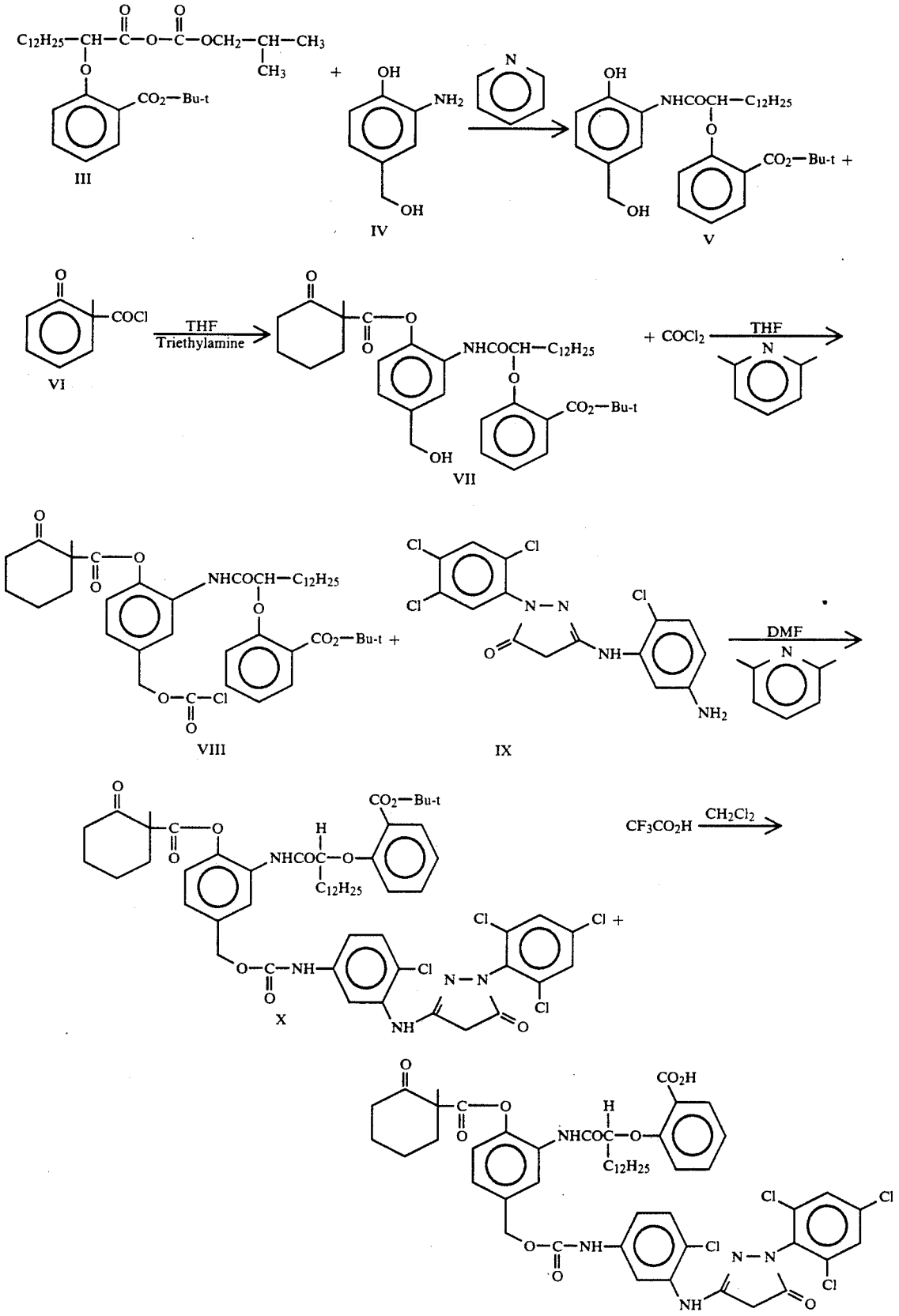

The preparation of coupler 2 will now be described with reference to the preparation scheme on pages 26–27.

Disulfide XII (1.2 g, 0.00138 mole) was dissolved in 20 ml of methylene chloride. Gaseous chlorine was bubbled in for thirty seconds, and the mixture was stirred an additional five minutes. The mixture was placed on a rotary evaporator and 100 ml of methylene chloride was evaporated off three separate times to afford the sulfenyl chloride, compound XIII (0.00138 mole).

Compound XIII (0.00138 mole) was dissolved in DMF, and the solid coupler X as prepared in the preparation of coupler 1 (3.0 g, 0.027 mole) was added all at once. The mixture was heated at 60° C. for forty-five minutes, and then stirred overnight. The reaction mixture was precipitated by pouring into 200 ml of ice water. The precipitate was collected and dried in a sintered glass funnel. After drying, the crude product was chromatographed on silica gel using dichloromethane/heptane/ethyl acetate as the eluent, starting with (5/3/2) and ending with (5/1/4) as the impurities came off. Compound XIV (2.3 g, 0.0015 mole) as a foam was obtained.

Coupler XIV (2.3 g, 0.0015 mole) was dissolved in 25 ml dichloromethane. Trifluoroacetic acid (10.3 g, 0.09 mole, 6.7 ml) was added and the reaction mixture was stirred for ten minutes. The reaction was then diluted with 100 ml ethyl acetate and washed with excess 1N $NaHCO_3$, $H_2O$, 1N HCL, and $H_2O$. The organic phase was dried over $MGSO_4$ and concentrated to a foam (2.2 g), coupler 2.

Preparation Scheme For Coupler 2

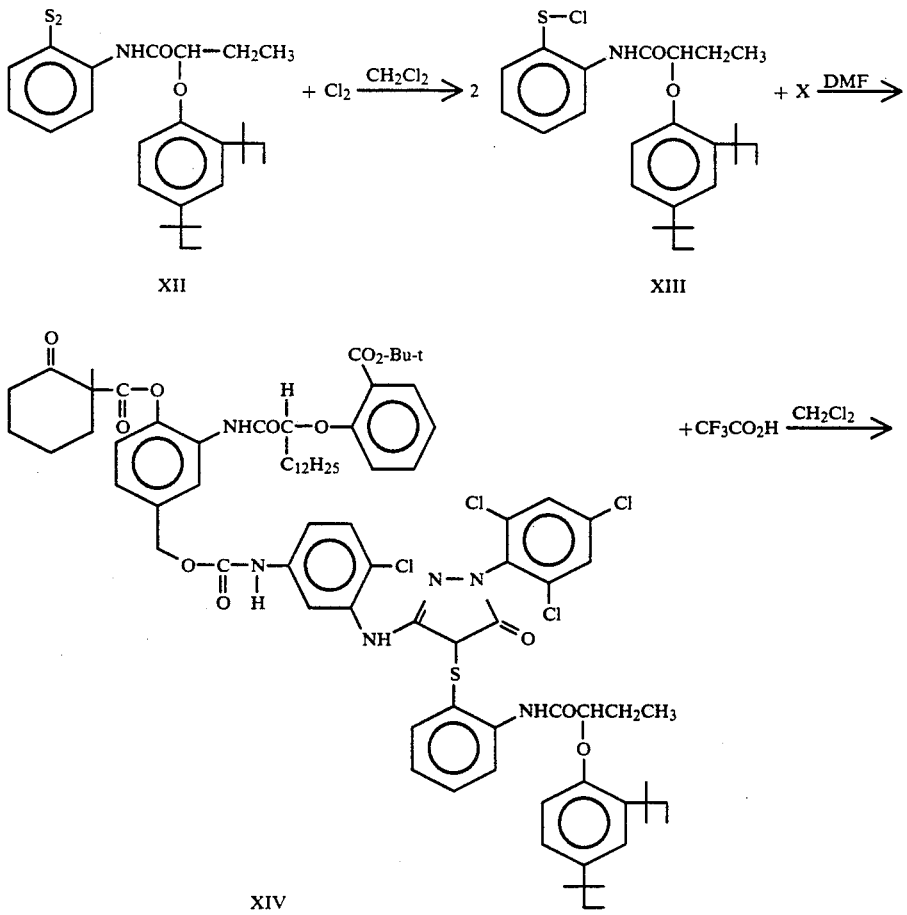

-continued

Preparation Scheme For Coupler 2

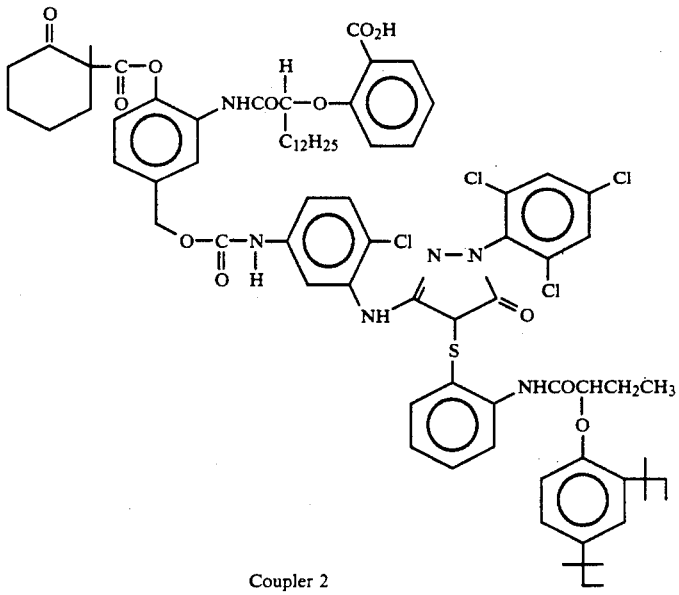

Coupler 2

The couplers of this invention can be incorporated in silver halide emulsions and the emulsions can be coated on a support to form a photographic element. Alternatively, the coupler can be incorporated in the photographic element adjacent to the silver halide emulsion where, during development, the coupler will be in reactive association with development products such as oxidized color developing agent.

The photographic elements in which the couplers of this invention are employed can be either single color or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements according to the invention, reference will be made to Research Disclosure, December 1978, Item 17643, and December 1989, Item 308119, published by Kenneth Mason Publications, Ltd., Emsworth, Hampshire PO10 7DQ, U.K., the disclosures of which are incorporated in their entireties herein by reference. This publication will be identified hereafter as "Research Disclosure". The elements of the invention can comprise emulsions and addenda described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed by Mignot, U.S. Pat. No. 4,386,156; Wey, U.S. Pat. No. 4,399,215; Maskasky, U.S. Pat. No. 4,400,463; Wey et al., U.S. Pat. No. 4,414,306; Maskasky, U.S. Pat. No. 4,414,966; Daubendiek et al., U.S. Pat. No. 4,424,310; Solberg et al., U.S. Pat. No. 4,433,048; Wilgus et al., U.S. Pat. No. 4,434,226; Maskasky, U.S. Pat. No. 4,435,501; Evans et al., U.S. Pat. No. 4,504,570; and Daubendiek et al., U.S. Pat. Nos. 4,672,027 and 4,693,964. Also specifically contemplated are those silver bromoiodide grains with a higher molar proportion of iodide in the core of the grain than in the periphery of the grain, such as those described in U.K. Patent No. 1,027,146; Japanese Patent 54/48521; U.S. Pat. Nos. 4,379,837; 4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (for example, gold), middle chalcogen (such as sulfur, selenium or tellurium), and reduction sensitizers, employed individually or in combination, are specifically contemplated. Typical chemical sensitizers are listed in Research Disclosure, Item 17643, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Item 17643, Section IV and the publications cited therein.

Suitable vehicles for the emulsion layers and other layers of elements according to the invention are described in Research Disclosure, Item 17643, Section IX and the publications cited therein.

In addition to the smearing couplers described herein, the photographic elements according to the invention can include additional couplers such as those described in Research Disclosure Section VII, paragraphs D–G and the publications cited therein. These additional couplers can be incorporated as described in Research Disclosure Section VII, paragraph C and the publications cited therein. The coupler combinations according to the invention can be used with colored masking couplers such as described in U.S. Pat. Nos. 4,883,746, with image modifying couplers such as described in U.S. Pat. Nos. 3,148,062; 3,227,554; 3,733,201; 4,409,323; and 4,248,962 and with couplers that release bleach accelerators such as described in European Patent Application 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4- amino-3-methyl-N-ethyl-N-β-(methanesulfonamido)-ethylaniline sulfatehydrate, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfon-amido)ethyl-N,N-diethylaniline hydrochloride and 4-amino-N-ethyl-N-(2-methoxyethyl)-m-toluidine-di-p-toluene-sulfonic acid.

With negative-working silver halide, the process step described above leads to a negative image. The described elements are preferably processed in the known C-41 color process as described in, for example, the British Journal of Photography Annual of 1988, pages 196–198. To obtain a positive (or reversal) image, the color development step can be preceded by development with a nonchromogenic developing agent to develop exposed silver halide, but not form dye, and then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The inventive couplers are particularly useful in those situations in which low granularity is of great importance. One example would be in combination with large grain-sized emulsions (typically considered as greater than 1.5 micrometer in diameter) of either 3-D or T-grain morphology. Another example would be in combination with low laydowns of silver emulsion (typically less than 100 mg/ft$^2$ in a single color record).

The invention is further illustrated by the following examples, without being limited thereby. In the examples, comparative examples using the following couplers were performed:

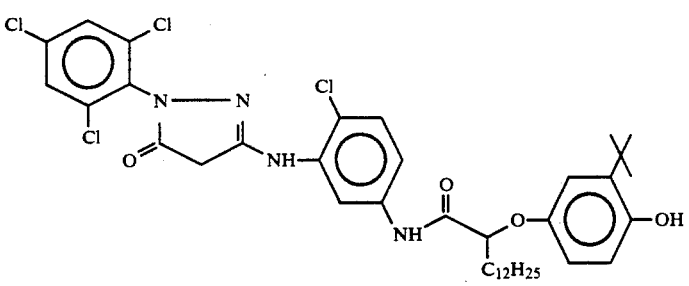

C1

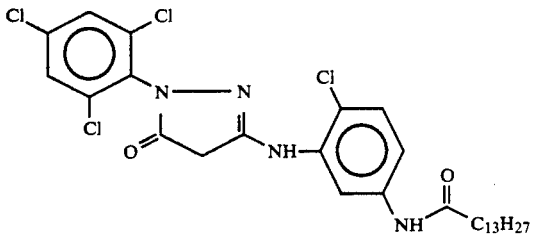

C2

These comparative couplers do not contain splittable linking groups and hence a carbamic acid is not produced during development.

EXAMPLE 1

Table 1 compares the photographic performance of couplers 1–3 which demonstrate the invention relative to similar materials C1 and C2 that have non-cleavable ballasts.

Couplers 1 and 2 both contain a splittable linking group as described in U.S. Pat. No. 5,019,492. This group is sensitive to hydroxylamine and is cleaved in a non-imagewise fashion during development. There is an additional solubilized/ballasted quinonemethide timing group between the cleavable site and the oxygen of the carbamate.

Coupler 3 releases the same carbamic acid solubilized dye in an image-wise manner. In this coupler, reaction of Dox (oxidized developer) with the unballasted naphthol portion of the molecule (a 'universal' or non-permanent dye forming coupler) releases the desired smearable coupler or dye through a ballasted quinonemethide timing group. It is not known if coupling with the pyrazolone nucleus occurs before, concurrent with, or after cleavage to reveal the carbamic acid group.

In the example, single layer photographic elements were prepared by coating a cellulose acetate-butyrate support film in the format shown below.

COATING FORMAT

| |
|---|
| 5.4 g/m$^2$ & 1.75 weight percent based on total gel bis-vinylsulfonylmethyl ether hardener |
| .65 mol/m$^2$ Coupler dispersed in dibutyl phthalate equal to 1/2 coupler weight |
| 3.8 g/m$^2$ Gelatin |
| 1.1 g/m$^2$ Silver bromide emulsion |

/////////////////////////SUPPORT/////////////////////////

Samples of each element were exposed imagewise through a stepped density test object and processed at 100° F. employing the following color processing solutions and dried to produce stepped colored images.

| Color Processing Solutions | |
|---|---|
| Color Developer Solution (3' 15") | |
| $K_2CO_3$ | 37.50 g |
| $Na_2SO_3$ | 4.25 g |
| KI | 0.02 g |
| NaBr | 1.30 g |
| Hydroxylamine sulfate (not present in 8610-9) | 2.00 g |
| 4-Amino-3-methyl-N-ethyl N-B'-Hydroxyethylaniline sulfate | 3.55 g |
| Water to make 1 liter, pH 10.0 | |
| Bleach (4'): | |
| Ammonium Bromide | 150.00 g |
| Ammonium ferric EDTA (1.56M) | 175.00 ml |
| Acetic Acid | 9.5 ml |
| Sodium Nitrate | 35.00 g |
| Water to make 1 liter, pH 6.0 | |
| Wash (1') | |
| Fix (4'): | |
| Ammonium thiosulfate (58%) | 214.00 g |
| (Ethylenedinitrilo)tetra-acetic acid, di-Na+ salt | 1.29 g |
| Sodium Metabisulfite | 11.00 g |
| NaOH (50%) | 4.70 g |
| Water to make 1 liter, pH 6.5 | |
| Wash (4') | |

At midscale exposure, the inventive couplers all have lower granularity than the comparative couplers. However, this is not a fair comparison because of the density differences between the couplers. These differences arise from changes in the rate of reaction with oxidized developer and partial loss of non-ballasted solubilized dye into the developer solution in this simple format.

Simple granularity theory (see "The Theory of the Photographic Process", T. James, Ed, Macmillan Publishing, NY, Chapter 21) states that granularity is proportional to the density divided by the square root of the number of developed centers. Accordingly, for the same emulsion and the same exposure the number of developed centers should be the same for all coatings. Thus, the ratio of RMS granularity/density should remain constant for all coatings. Comparison of this ratio should indicate whether or not a fundamental improvement in the granularity has been made. A smaller ratio implies an improvement in the granularity. As can be seen in Table 1, these carbamic acid substituent smearing couplers improve granularity and do not smear after completion of the development process.

Table 1 also compares the granularity for couplers and 2 when no hydroxylamine is present in the developer. Without hydroxylamine, the ballast group is not cleaved, the carbamic acid group is never formed and the coupler remains fully ballasted. Under these conditions, these couplers behave like conventional ballasted couplers such as C1 or C2. It is clear that formation of a carbamic group during development can improve granularity by increasing diffusion of the dye formed by reaction with oxidized developer. It should be noted that removal of hydroxylamine from the developer affects silver development and coupling rate and the photographic performance of a coupler may or may not be significantly altered.

TABLE 1

| | | Granularity Effects | | | |
|---|---|---|---|---|---|
| COUPLER | CONDITION | D(C41) | DNG (C41) | D(8610-9) | DNG (8610-9) |
| C1 | F | .696 | 39.1 | 0.985 | 38.8 |
| C1 | I | .706 | 39.2 | 0.993 | 40.1 |
| C2 | F | .812 | 32.5 | 0.925 | 35.6 |
| C2 | I | .839 | 32.3 | 0.928 | 35.3 |
| 1 | F | .323 | 24.5 | 1.069 | 29.4 |
| 1 | I | .396 | 24.2 | 1.052 | 30.2 |
| 2 | F | .698 | 26.2 | 0.864 | 36.4 |
| 2 | I | .775 | 26.8 | 0.861 | 37.9 |
| 3 | F | .420 | 27.6 | 0.384 | 34.9 |
| 3 | I | .454 | 25.3 | 0.360 | 34.7 |

F = Fresh Reading; I = Incubated 5 days @ 120 F./50% R.H. and reread
C41 = Standard C41 Process and Solutions; 8610-9 is the same as C41 except that the developer contains no hydroxylamine sulfate.
DNG = Density Normalized Granularity which is the RMS granularity divided by the green density (D) at that exposure step.
All data at a midscale exposure in the green record.

EXAMPLE 2

As shown in Example 1, when couplers 1 and 2 are processed in a developer that does not contain hydroxylamine (8610-9 as in Table 1), the splittable linking group is unaffected and the carbamic acid group never forms. Normal coupling can occur in the presence of Dox to generate dyes which still retain an intact carbamic acid precursor group. Under the conditions of C41 development (contains hydroxylamine), the splittable linking group is removed, revealing a carbamic acid solubilized species, which eventually decomposes to leave the corresponding amine substituted dye.

These already processed coatings can be used to further illustrate the principles described. For couplers 1 and 2, reprocessing an 8610-9 developed coating (which contains a dye with an intact carbamic acid precursor group) in C41 will remove the splittable linking group and create the carbamic acid solubilized dye which is free to diffuse (see the reaction scheme below). In this situation, any improvement in granularity originates from movement of the dye alone since no coupling/silver development is involved (the silver being removed during the first 8610-9 development). Reprocessing coatings that had been originally processed in C41 (which contains a amine-substituted dye resulting form decarboxylation of the carbamic acid) should have little effect since the dye is poorly solubilized.

Other couplers, such as C1, C2, or 3, which do not contain hydroxylamine sensitive linking groups are relatively unaffected by these reprocessing treatments. Some dye diffusion ("smear") is possible if the coupler is not heavily ballasted, since the developer pH of about 10 is high enough to ionize the coupler site, thus creating some solubilization. As shown in Table 2, both couplers 1 and 2 show a significant improvement in DNG when 8610-9 processed coatings are subsequently exposed to C41 conditions. This improvement is due strictly to the formation of a carbamic acid substituted dye and is totally independent of silver development effects. Reprocessing C41 processed strips has little effect since the carbamic acid substituent cannot be reformed. The controls also show little effect under either scenario.

Reaction Scheme

Figure 1

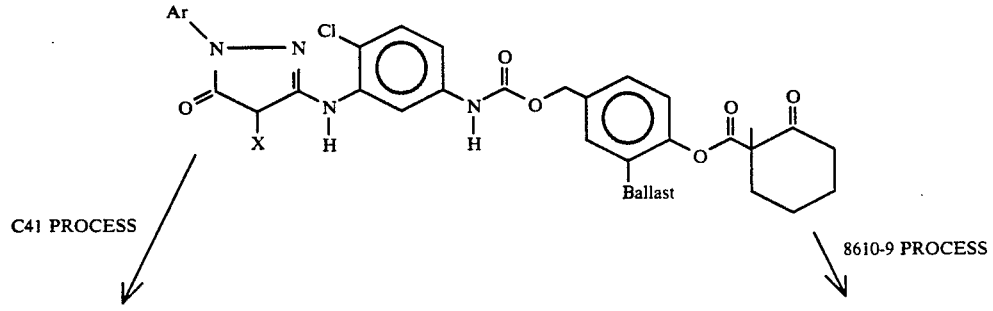

-continued

Reaction Scheme

Figure 1

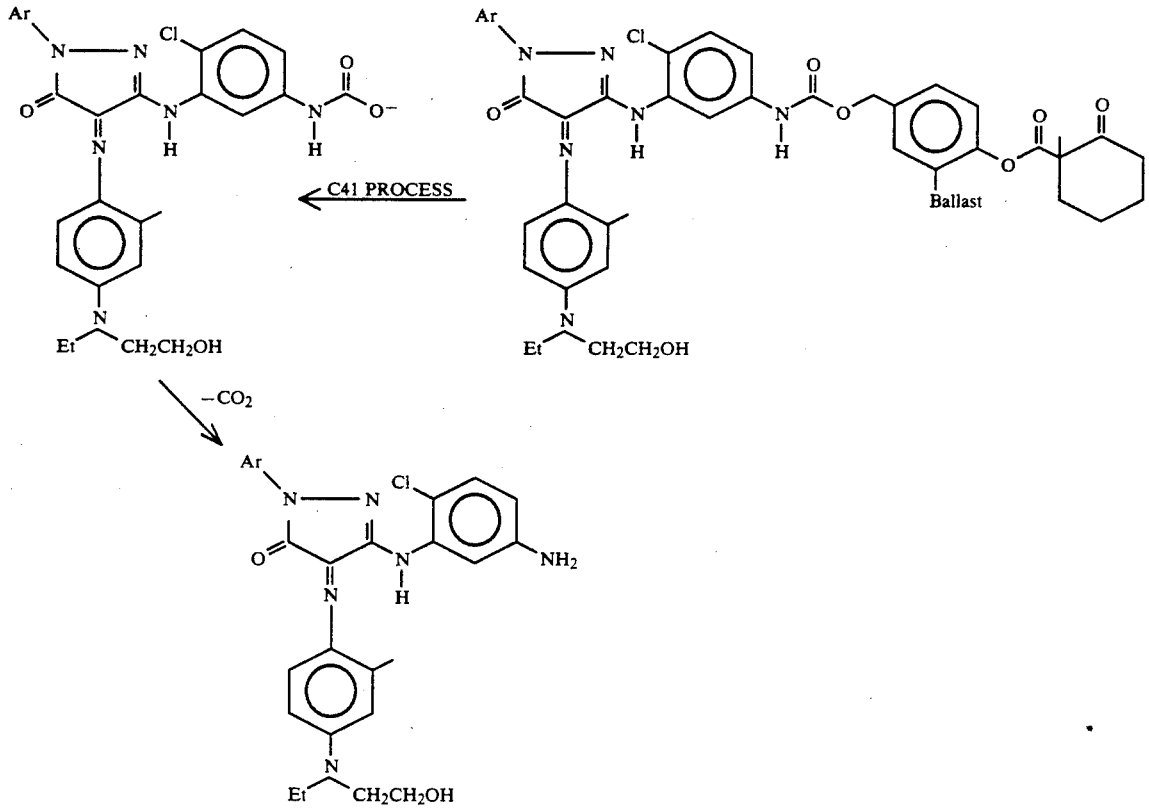

TABLE 2

| Granularity Effects From Post-Process Treatment | | | | | |
|---|---|---|---|---|---|
| COUPLER | CONDITION | D(C41) | DNG (C41) | D(8610-9) | DNG (8610-9) |
| C1 | Initial | .740 | 37.3 | 1.011 | 40.3 |
| C1 | Reprocess | .748 | 36.8 | 1.008 | 40.5 |
| C2 | Initial | .738 | 32.9 | 0.930 | 38.2 |
| C2 | Reprocess | .753 | 31.7 | 0.939 | 34.1 |
| 1 | Initial | .348 | 23.9 | 1.411 | 24.6 |
| 1 | Reprocess | .339 | 23.7 | 1.342 | 18.6 |
| 2 | Initial | .775 | 26.7 | 0.861 | 37.9 |
| 2 | Reprocess | .794 | 24.4 | 0.878 | 33.1 |
| 3 | Initial | .421 | 27.0 | 0.459 | 36.2 |
| 3 | Reprocess | .474 | 25.3 | 0.506 | 34.4 |

Initial = Granularity after indicated process;
Reprocess = Same coatings reread after reprocessing in C41 (contains hydroxylamine).
C41 = Standard C41 Process and Solutions;
8610-9 is the same as C41 except that the developer contains no hydroxylamine sulfate.

The invention has been described in detail with particular reference to preferred embodiments thereof, but it will be understood that variations and modifications can be effected within the spirit and scope of the invention.

What is claimed is:

1. A photographic element comprising a support, a sliver halide emulsion, and a coupler containing a carbamic acid precursor not attached to the coupling position of the coupler capable of being converted into a carbamic acid group, wherein during development said precursor is converted into a carbamic acid group thus allowing diffusion of the coupler or the dye derived from the coupler and whereafter the carbamic acid group decomposes into an amine and carbon dioxide resulting in a substantially non-diffusible dye.

2. A photographic element as in claim 1, wherein the coupler has the structure:

$$\text{COUP-L}-\text{N(R)COO}-(\text{T}_1)_m-\text{SL}(\text{BALLAST})_p-(\text{T}_2)_n-(\text{BALLAST})_r(\text{BALLAST})_q$$

wherein:

COUP represents a coupler moiety,

L represents a bond or a spacing group,

R is selected from hydrogen, substituted or unsubstituted alkyl, substituted or unsubstituted aryl, or the atoms necessary to form a ring system which joins the nitrogen back to the coupler, $T_1$ and $T_2$ are timing groups, m and n are integers from 0 to 2, SL is a splittable linking group, which is cleaved during development, BALLAST is at least one ballast group, and p, q, and r are independently 0 or 1, with at least one BALLAST group being present in the smearing coupler, with the proviso that neither L, if present, nor the carbamate group is attached to COUP in a coupling position nor attached to a part of the molecule that does not form a dye when reacted with oxidized developer.

3. A photographic element of claim 2, wherein SL is splittable by a hydrolysis reaction, an oxidation reaction, a reduction reaction, a catalysis reaction, or a combination thereof.

4. A photographic element of claim 2, wherein splitting of SL involves hydrolysis of an ester, a ketal, or an acetal.

5. A photographic element of claim 2, wherein said coupler is of the formula

1.

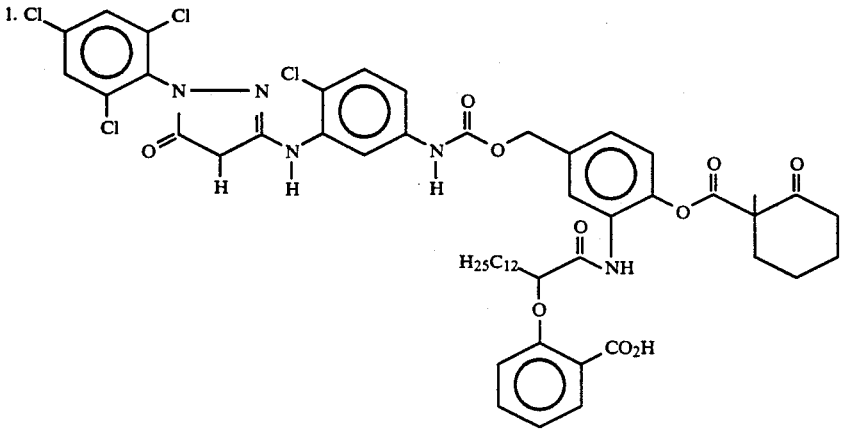

or

2.

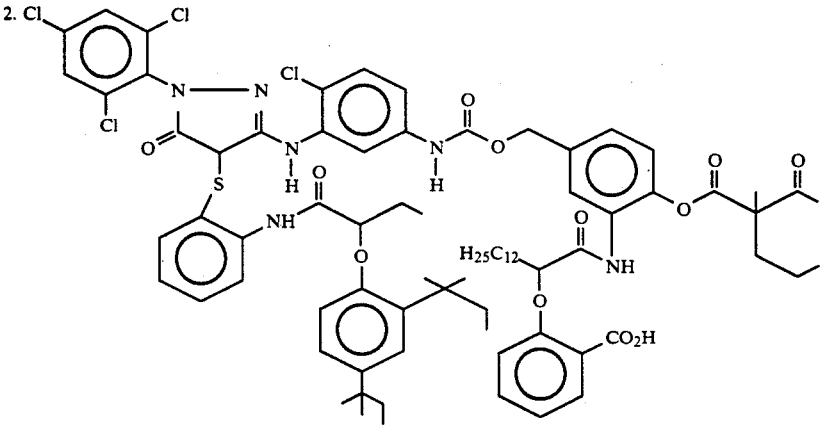

or

3.

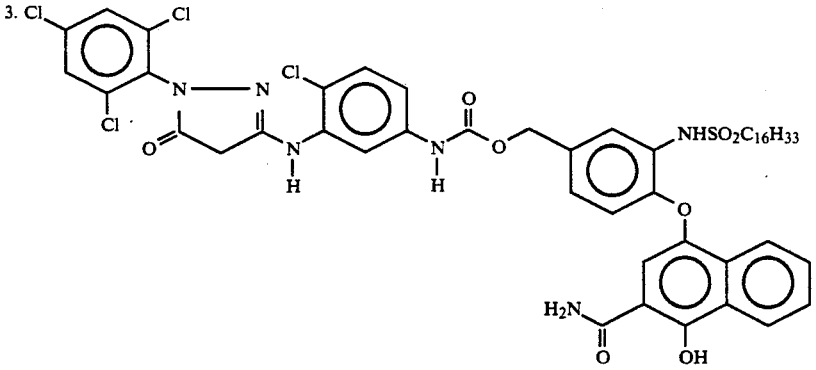

6. A photographic element of claim 2, wherein a secondary ballast is attached to the COUP moiety at a noncoupling position.

7. A photographic element of claim 2, wherein L is a spacing group.

8. A photographic element of claim 2, wherein m is at least 1.

9. A photographic element of claim 2, wherein n is at least 1.

10. A photographic element of claim 1, wherein said silver halide emulsion is a large grain-sized emulsion having grains of greater than about 1.5 micrometers in diameter.

11. A process for developing an image in a photographic element comprising a support and a silver halide emulsion containing an imagewise distribution of developable silver halide grains, said process comprising the step of developing said element with a silver halide color developing agent in the presence of a dye-forming coupler which comprises a carbamic acid precursor not attached to the coupling position of the coupler capable of forming a carbamic acid group, wherein during development said precursor is converted into a carbamic acid group thus allowing diffusion of the coupler or the dye derived from the coupler and whereafter the carbamic acid group decomposes into an amine and carbon dioxide resulting in a substantially non-diffusible dye.

12. A process of claim 11, wherein the coupler has the structure:

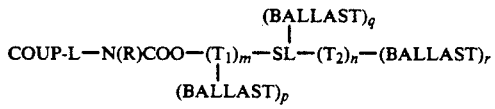

wherein:

COUP represents a coupler moiety,

L represents a bond or a spacing group,

R is selected from hydrogen, substituted or unsubstituted alkyl, substituted or unsubstituted aryl, or the atoms necessary to form a member ring system which joins the nitrogen back to the coupler, $T_1$ and $T_2$ are timing groups, m and n are integers from 0 to 2, SL is a splittable linking group, which is cleaved during development, BALLAST is at least one ballast group, and p, q, and r are independently 0 or 1, with at least one BALLAST group being present in the smearing coupler, with the proviso that neither L, if present, nor the carbamate group is attached to COUP in a coupling position nor attached to a part of the molecule that does not form a dye when reacted with oxidized developer.

13. A process of claim 11 which comprises the steps of:

(a) reacting an oxidized color developing agent with the coupler under alkaline conditions so as to form a dye having a carbamic acid group which is free to diffuse, and (b) lowering the pH so as to decompose the carbamic acid group into carbon dioxide and an amine, wherein the dye is rendered substantially immobile.

14. A process of claim 12 wherein the coupler is of the structural formula

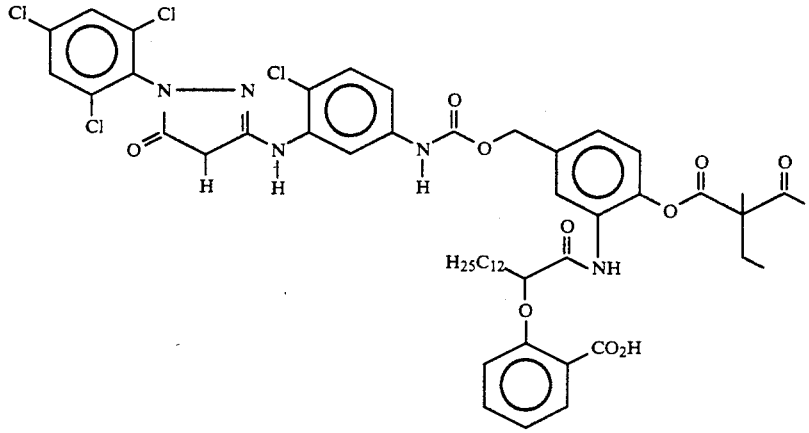

or

2.

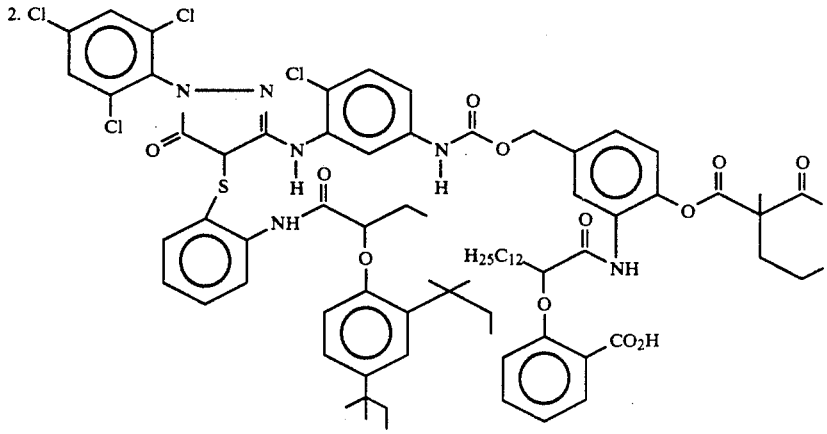

or

-continued

3.

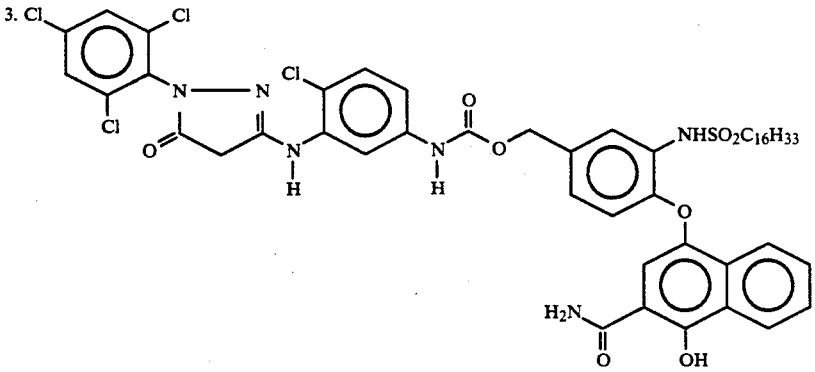

15. A photographic element of claim 1, wherein said coupler is a cyan dye-forming coupler.

16. A photographic element of claim 1, wherein said coupler is present in a silver halide emulsion layer.

17. A photographic element of claim 2, wherein SL is splittable by image-wise cleavage.

18. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein said element comprises a coupler containing a carbamic acid precursor not attached to the coupling position of the coupler capable of being converted into a carbamic acid group, wherein during development said precursor is converted into a carbamic acid group thus allowing diffusion of the coupler or the dye derived form the coupler and whereafter the carbamic acid group decomposes into an amine and carbon dioxide resulting in a substantially non-diffusible dye.

19. A multilayer photographic element as claimed in claim 18, wherein the coupler is of the structure:

$$\text{COUP-L-N(R)COO-}\underset{\underset{(\text{BALLAST})_p}{|}}{(\text{T}_1)_m}\text{-}\overset{\overset{(\text{BALLAST})_q}{|}}{\text{SL}}\text{-}(\text{T}_2)_n\text{-}(\text{BALLAST})_r$$

wherein:

COUP represents a coupler moiety,

L represents a bond or a spacing group,

R is selected from hydrogen, substituted or unsubstituted alkyl, substituted or unsubstituted aryl, or the atoms necessary to form a ring system which joins the nitrogen back to the coupler, $T_1$ and $T_2$ are timing groups, m and n are integers from 0 to 2, SL is a splittable linking group, which is cleaved during development, BALLAST is at least one ballast group, and p, q, and r are independently 0 or 1, with at least one ballast group being present in the smearing coupler, with the proviso that neither L, if present, nor the carbamate group is attached to COUP in a coupling position nor attached to a part of the molecule that does not form a dye when reacted with oxidized developer.

20. A multilayer photographic element as claimed in claim 19, wherein COUP is a universal coupler moiety.

21. A photographic element comprising a support, a silver halide emulsion, and a magenta, yellow, black, or colorless dye-forming coupler containing a carbamic acid precursor capable of being converted into a carbamic acid group, wherein during development said precursor is converted into a carbamic acid group thus allowing diffusion of the coupler or the dye derived from the coupler and whereafter the carbamic acid group decomposes into an amine and carbon dioxide resulting in a substantially non-diffusible dye.

22. A photographic element of claim 2, wherein SL is splittable by nonimage-wise cleavage.

23. A photographic element of claim 2, wherein said coupler contains a primary and secondary ballast, wherein said resulting dye contains said secondary ballast, but not said primary ballast.

24. A photographic element of claim 2, wherein the resulting dye is unballasted.

25. A photographic element of claim 21, wherein said coupler is a magenta dye-forming coupler.

26. A photographic element of claim 21, wherein said coupler is a yellow dye-forming coupler.

27. A photographic element of claim 2, wherein m and p are both at least 1.

28. A photographic element of claim 27, wherein $T_1$ is a solubilized quinonemethide timing group.

29. A photographic element of claim 18, wherein said coupler containing a carbamic acid precursor is a yellow-dye forming coupler which is present in said yellow dye image-forming unit.

30. A photographic element of claim 18, wherein said coupler containing a carbamic acid precursor is a magenta-dye forming coupler which is present in said magenta dye image-forming unit.

31. A photographic element of claim 18, wherein said coupler containing a carbamic acid precursor is a cyan-dye forming coupler which is present in said cyan dye image-forming unit.

* * * * *